US005720049A

United States Patent [19]

Clutton

[11] Patent Number: 5,720,049

[45] Date of Patent: Feb. 24, 1998

[54] SCARF

[76] Inventor: Geoffrey Clutton, Briar Lane, Newlands, Drax, Selby, Great Britain, YO8 8PS

[21] Appl. No.: 530,324

[22] PCT Filed: Mar. 17, 1994

[86] PCT No.: PCT/GB94/00543

§ 371 Date: Sep. 28, 1995

§ 102(e) Date: Sep. 28, 1995

[87] PCT Pub. No.: WO95/04482

PCT Pub. Date: Feb. 16, 1995

[30] Foreign Application Priority Data

Aug. 6, 1993 [GB] United Kingdom ..... 9316372

[51] Int. Cl.[6] ..... A41D 23/00

[52] U.S. Cl. ..... 2/207; D2/500; D2/600; D2/609; 2/171

[58] Field of Search ..... 2/144, 145, 155, 2/156, 311, 321, 338, 207, 208, 171; 63/3, 4; D2/500, 501, 502, 600, 602, 605, 607, 609, 625, 627, 639, 640

[56] References Cited

U.S. PATENT DOCUMENTS

| | | | |
|---|---|---|---|
| D. 289,227 | 4/1987 | Glynn | D2/627 |
| 1,896,060 | 1/1933 | Colby | D2/627 |
| 1,897,333 | 2/1933 | Resseguie | 2/155 |
| 5,440,787 | 8/1995 | Figueroa et al. | 2/155 |

FOREIGN PATENT DOCUMENTS

| | | | |
|---|---|---|---|
| 330842 | 6/1930 | United Kingdom | 2/321 |

*Primary Examiner*—Diana Biefeld
*Attorney, Agent, or Firm*—Galgano & Burke

[57] ABSTRACT

An article of clothing which comprises one or more pieces of fabric which are gathered within a member and releasably held together at predetermined ends by weighted attachment means thereby securing the article of clothing about an individual and allowing the material to hang in an attractive manner.

7 Claims, 1 Drawing Sheet

SCARF

The invention relates to an article of clothing for wearing, particularly, but not exclusively, about the neck of an individual.

Articles of clothing, and particularly accessories, such as scarfs, shawls, neckerchiefs, cravats and the like, typically comprise a single piece of generally elongate and typically rectangular material which is worn draped or tied around a wearer's neck.

FR-2297577 discloses for example a loosely knitted cylindrical muff which is gathered at its outer most ends and provided at these ends with a pompon. The muff can be worn as a scarf, hat or belt. When used as a hat the cylindrical muff is folded in on itself, so that an opening is formed for affixing the muff to an individual's head. When used as a belt, the muff is tied by a knot or other special attachment.

In the instance where an article is draped around a wearer's neck the wearer suffers the inconvenience of having the draped article alter in position or even fall off as the individual moves around. In the instance where the article is held in place by fastening or tying or the like, one typically finds that the article becomes creased or even possibly damaged at the site where a knot is tied, and in any event the article is still likely to be altered in position although it is less likely to fall off.

There is therefore a need to provide such an article of clothing which can be worn more reliably and further, which is so innovatively designed and held in position that it can be worn in a number of ways and so to a number of advantages.

According to the invention there is therefore provided an article of clothing for wearing about an individuals neck or middle comprising: at least one elongate piece of fabric having provided at either end thereof at least one drawing member into which at least part of an end of the fabric is drawn; and an attachment member for bringing said drawings members releasably theretogether wherein at least one of said drawing members or attachment member is weighted.

It follows from the above that the article of the invention is fashioned, by the drawing-in members and attachment member, into a loop structure which can be worn to advantage about a user's neck.

In a preferred embodiment of the invention said drawing members and attachment member comprise aesthetically designed pieces which are appealing to a wearer, for example, such pieces may be fashioned in accordance with items of modern jewellery.

In a preferred embodiment of the invention and in particular, where only one piece of fabric is used, said fabric is printed such that an appealing pattern, colour or texture is provided on both sides of the fabric.

In yet a further embodiment of the invention said fabric comprises one elongate piece of fabric which is fashioned in tubular form so that what is commonly known as the right side of the fabric only is viewable when the article is worn.

According to a yet further aspect of the invention there is provided an article of clothing for wearing about an individual comprising a plurality of the aforedescribed articles releasably joined theretogether by way of the provision of a common and complementary attachment member provided on each article.

According to this further aspect of the invention the said attachment member may comprise a screw barrel arrangement. That is to say a two part member which has the outward appearance of a barrel when the two parts are joined theretogether and which comprises a first part having at the attachment end thereof a projecting member including an outer threaded portion and the other part having at the attachment end thereof an inner recess portion which includes a screw thread complementary to said thread on said other portion.

It will be evident that, using the aforementioned arrangement, a number of articles can be joined theretogether by simply mating the appropriate ends of said screw barrel arrangement. Thus, a number of articles can be joined together to form a sash which will be appropriately Weighted at pre-determined intervals.

It is to be understood that the article may have any preferred or conventional forms of attachment members. It is not intended that the invention is to be limited by the single attachment described herein.

An embodiment of the invention will now be described, by way of example only, with reference to the accompanying Figures wherein.

Figure 1:
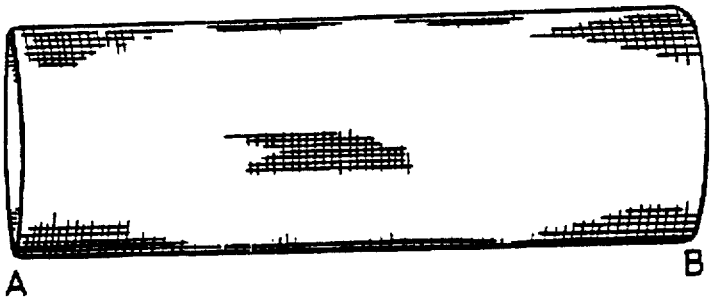
FIG. 1 represents a plan view of a fabric for use in accordance with the invention.
Figure 2:
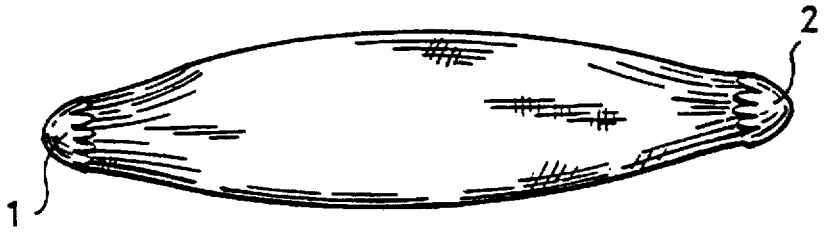
FIG. 2 represents a plan view of the fabric shown in FIG. 1 after the ends have been drawn.

Referring to the Figures and firstly to FIG. 1, there is shown a plan view of a single piece of fabric for use in the invention. Where only one piece of fabric is to be used in an unfolded fashion, it will be clear that the fabric selected must have appeal when viewed from both sides. Since this may be rare it will be more commonplace to use a single piece of fabric which is folded in half along its longitudinal axis so as to provide, when appropriately sewn, a tubular member. However, it will be clear that said tubular member may be formed by joining theretogether, along two seams, two ideally equally sized and similarly or complementary coloured or patterned or textured pieces of fabric. However, it is also possible to provide at least two contrasting or different pieces of fabric for joining theretogether so as to form a desired tubular shape comprising a plurality of strips of sections of fabric.

Figure 3:
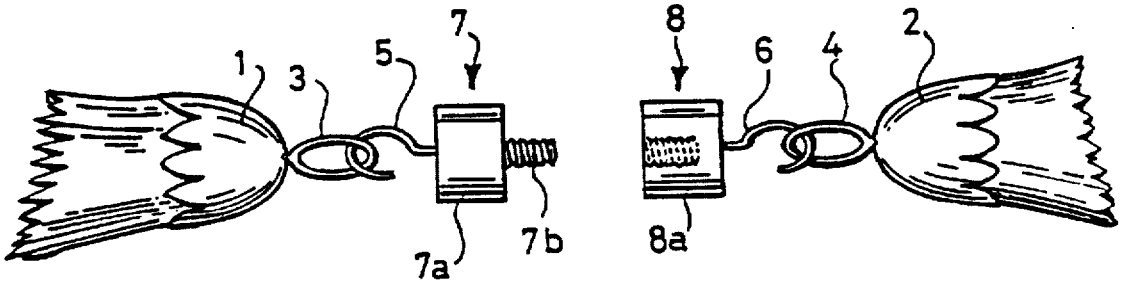
FIG. 3 represents a plan view of an attachment member for use in the invention.

Once the tubular member has been made the outer most ends A-B thereof are drawn together to form two reduced and gathered ends which are secured in any conventional way by means of drawing-in members 1, 2 provided at ends A-B respectively. Drawing-in members 1, 2 may take any preferred shape and configuration but it is thought that a particularly attractive arrangement comprises an appealingly plated metallic member which is shaped into a cup shape having an upper fluted edge as best seen in FIG. 3. The cup shape may be provided with any preferred pattern, indentation, sculpturing or the like.

Having drown the fabric as aforedescribed, one is provided with an essentially inched or gathered article.

The ends of said article are joined theretogether using an attachment member and ideally an attachment member as illustrated in FIG. 3. This attachment member comprises a rigid loop 3 or 4 attached to the bottom central portion of cups 1 and 2 respectively. Hook members 5 and 6 engage at a first outer most end with loops 3 and 4 respectively and are attached at the other end to first and second barrel members 7 and 8. Barrel member 7 comprises a first decorative part 7*a* and a second protruding part 7*b* located centrally on the, in use, inner most side of barrel 7. Protruding part 7*b* is provided with an outer most screw thread arrangement.

Barrel member 8 comprises an aesthetic part 8a having a centrally located aperture protruding inwards towards the centre of the barrel from the inner most surface of the barrel. Said inner part is provided with a screw thread arrangement complementary to said screw thread arrangement on protruding part *7b*.

In use, member *7b* is inserted into the aperture provided in barrel member 8 and screwed into position. In this way, the two ends A and B of the fabric are brought theretogether.

Ideally, cups 1 and 2 and barrel members 7 and 8 are made of a relatively weighty material so as to provide weight to the article. This ensures that the article can be suitable positioned and draped about a wearer.

The article may be worn in a number of appealing ways. For example, the two ends of the article may be positioned at the back of a wearer's neck and the length of the article provided on the front of a wearer may be so arranged such that the lower most part forms a single straight folded edge, rather like a conventional arm sling, which can then be tucked into the front of a skirt or pair of trousers. A cardigan or jacket worn over this arrangement creates the impression that the article is a wrap over blouse.

Alternatively, the article may be worn at a cummerbund, neck choker, edge to a jacket, head scarf, neck scarf, sash or in any other appealing way.

In the instance where the article is to be worn as a sash, it is possible to join a plurality of articles theretogether so as to create an extended length. This is possible where a number of such articles have the same fastening members so that the joining theretogether of complementary fastening members is possible.

It will be apparent from the above that the invention comprises an innovative and appealing article which as a result of the weighting and fashionable appearance of the attachment member can be worn in a number of positions and ways to advantage.

I claim:

1. A scarf-like article of clothing, comprising;

a) at least one elongated piece of fabric having at least two predetermined ends;

b) a pair of drawing-in members into each of which one of said predetermined ends of said fabric is drawn and gathered;

c) means for releasably attaching said pair of drawing-in members, wherein at least one of said drawing-in members and said attachment means is weighted so that the article of clothing can be positioned about a wearer.

2. An article of clothing according to claim 1 wherein said fabric is elongated and said drawing-in members and attaching means are provided at different said predetermined ends of said fabric.

3. An article of clothing according to claim 2 wherein said fabric is tubular and comprises two sides and said fabric is arranged so that only one of said sides of said fabric is viewable when the article is worn.

4. An article of clothing according to claim 1 wherein said drawing-in members and said attachment means comprise aesthetically designed pieces.

5. An article of clothing according to claim 1 wherein said fabric comprises two sides and is printed such that an appealing pattern, color or texture is provided on both of said sides of said fabric.

6. An article of clothing according to claim 1 wherein said attachment means comprises complimentary mating members.

7. An article of clothing according to claim 6 wherein said attachment means comprises a two part member in the form of a screw barrel arrangement, said screw barrel arrangement comprising:

a) a first part comprising a projecting member having an outer threaded portion; and b) a second part comprising an inner recess portion having a screw thread which is complimentary to said outer threaded portion of said projecting member.

* * * * *